US007132998B2

(12) United States Patent
Ryou et al.

(10) Patent No.: US 7,132,998 B2
(45) Date of Patent: Nov. 7, 2006

(54) MULTIPLE BANDS TYPE ANTENNA AND METHOD FOR PRODUCING THE SAME

(75) Inventors: Byung-Hoon Ryou, Ansan-si (KR); Weon-Mo Sung, Kwangju (KR)

(73) Assignee: E.M.W. Antenna Co., Ltd., Seoul (KR)

( * ) Notice: Subject to any disclaimer, the term of this patent is extended or adjusted under 35 U.S.C. 154(b) by 0 days.

(21) Appl. No.: 10/518,133

(22) PCT Filed: Jun. 25, 2002

(86) PCT No.: PCT/KR02/01212

§ 371 (c)(1),
(2), (4) Date: Dec. 14, 2004

(87) PCT Pub. No.: WO04/001896

PCT Pub. Date: Dec. 31, 2003

(65) Prior Publication Data

US 2005/0243012 A1 Nov. 3, 2005

(51) Int. Cl.
*H01Q 1/36* (2006.01)
*H01Q 1/24* (2006.01)

(52) U.S. Cl. ..... 343/895; 343/702

(58) Field of Classification Search ..... 343/895, 343/702, 900, 901
See application file for complete search history.

(56) References Cited

U.S. PATENT DOCUMENTS 4,772,895 A 9/1988 Garay et al. ..... 343/895
5,661,495 A 8/1997 Saldell ..... 343/702
5,764,191 A 6/1998 Tsuda ..... 343/702
5,861,859 A 1/1999 Kanayama et al. ..... 343/895
6,057,807 A * 5/2000 Marthinsson et al. ..... 343/895
6,075,488 A * 6/2000 Hope ..... 343/702
6,215,451 B1 * 4/2001 Hadzoglou ..... 343/715
6,262,693 B1 * 7/2001 Sutter et al. ..... 343/895
6,369,775 B1 * 4/2002 Moore et al. ..... 343/893

FOREIGN PATENT DOCUMENTS

EP 593185 10/1993

* cited by examiner

*Primary Examiner*—Shih-Chao Chen
*Assistant Examiner*—Minh Dieu A
(74) *Attorney, Agent, or Firm*—patenttm.us; James H. Walters

(57) ABSTRACT

The present invention relates to a multiple band-type antenna and method of producing the same. In the present invention, a connector member formed by cutting a cylindrical metallic rod and a first helical antenna are integral through a connection member. A space forming an impedance transformer is formed at the connection member for thereby widening a band region based on a series inductance effect. A helical antenna and a whip antenna are additionally installed at a center of the dielectric surrounding the inner and outer sides of the first helical antenna and the connection member for thereby enhancing an efficiency of the antenna by overcoming the unbalance problems encountered in the conventional art.

22 Claims, 16 Drawing Sheets

MULTIPLE BANDS TYPE ANTENNA AND METHOD FOR PRODUCING THE SAME

TECHNICAL FIELD OF THE INVENTION

This application is a 371 of PCT/KR02/01212 Jun. 25, 2002.

The present invention relates to a multiple bands type antenna and a method for producing the same, and in particular to a multiple bands type antenna and a method for producing the same in which a connector and a helical antenna get integral using a connection member by cutting a cylindrical metal rod, and an impedance transformer is formed in such a manner that a certain space is formed in the connection member.

BACKGROUND OF THE INVENTION

In a general feeding structure of a conventional small-sized antenna used in wireless communications, a coaxial line is directly brought into contact with an antenna to perform feeding. For monopole antennas, a + part of a coaxial line is brought into contact with an antenna to perform feeding. For dipole antennas, + and − parts of a coaxial line are brought into contact with an antenna to perform feeding.

These methods cause an unbalance condition between feeding lines of an antenna, so impedance matching becomes quite difficult. Additionally, a contact point between the antenna and the feeding line frequently varies, so the characteristics of the antenna are not constant, thus reducing the efficiency of the antenna.

As depicted in FIG. 1, U.S. Pat. No. 4,772,895 circular plateloses an antenna 500 that broadens the frequency response. The antenna 500 includes a feed port 550 having a signal feed portion and a ground portion, a first helical antenna element 520 having opposed ends and exhibiting a first pitch and a second electrical length, one end of the first helical antenna element 520 being coupled to the signal feed portion of the feed port, and a second helical antenna element 540 having opposed ends and exhibiting a second pitch and a second electrical length.

The second helical antenna element 540 is coaxially wound around a portion of the first helical antenna element 520, one end of the second helical antenna element 540 is coupled to the ground portion of the feed port 550, and the second pitch is equal to approximately ½ of the first pitch and the second electrical length is equal to approximately ⅓ of the first electrical length.

The antenna 500 is provided with a cylindrical spacer means 530 that is coaxially situated between the first and second helical antenna elements 520 and 540 to electrically insulate the first and second helical antenna elements 520 and 540. The spacer means 530 is sufficiently thin such that the first helical antenna element 520 is tightly coupled to the second helical antenna element 540 so as to broaden the frequency response exhibited by the first helical antenna element 520.

In the conventional antenna, the spacer means is situated between the first and second helical antenna elements, and is used to ground the antenna elements. The conventional antenna is problematic in that it cannot overcome the unbalance condition that is a problem in the conventional antenna, thus causing low efficiency, and it is difficult to miniaturize.

With respect to the unbalance condition, helical antennas are chiefly classified into normal mode antennas and axial mode antennas. The case where the circularly shaped circumference of the helical antenna is considerably smaller than a wavelength corresponding to a working frequency falls under normal mode. Generally, helical antennas used in wireless communications devices have normal mode.

The characteristics of the normal mode helical antenna are that the characteristic impedance is considerably large and the radiation resistance value corresponding to actual radiation power is small. Accordingly, the input impedance value is considerably large in total and considerably different from the output impedance, 50 Ω, so the reflection loss is increased. This is the inherent unbalance condition of the conventional helical antenna that is used as a general wireless communications receiving antenna.

As illustrated in FIG. 2, U.S. Pat. No. 5,661,495 circular plateloses an antenna device 200 having circuits 230 for transmitting and/or receiving radio signals as well as a chassis 250 and a feeding point providing the electrical coupling of the antenna device to the communication equipment, which includes a hollow helical antenna 210 fixed externally on the chassis 250 and an antenna rod 220 slidable through the helical antenna 210, the helical antenna being coupled constantly via the feeding point to the circuits 230.

Meanwhile, the bandwidth of the helical antenna 210 is increased, a tuned ground surface is arranged near the feeding point, a direct Galvani electrical contact is not formed, and the ground surface is coupled to the protective earth of a communications device and can catch mirror current.

In the conventional antenna device, when the antenna rod is extended from a housing, the antenna rod and the helical antenna are coupled in parallel to the circuits 230. When the antenna rod 220 is retracted into the chassis 250, only the helical antenna is coupled to the circuits 230.

Meanwhile, a circuit equivalent to the case where a helical antenna is installed in a general cylindrical structure chiefly consists of a feeding part and the parallel resonance parts of L and C. This conventional helical antenna reduces the length of the conventional monopole antenna but has the same resonant frequency as the conventional monopole antenna. In this case, the Q value is increased due to the parallel resonance of L and C, so a band of frequencies is narrowed.

Accordingly, with reference to a graph showing the electrical characteristics of a conventional helical antenna in Voltage Standing Wave Ratios (VSWRs) and a Smith Chart showing impedance measurement data, as shown in FIGS. 4*a* and 4*b*, as the VSWR value is increased and the impedance value is away from the center of the Smith Chart, the reflection loss of the antenna is increased and the bandwidth of the antenna is narrowed.

The bandwidths of the conventional antennas having structures shown in FIGS. 1 and 2 are each defined as a band of frequencies having a VSWR value equal to or less than 2. Accordingly, the conventional antennas each have a VSWR value ranging from 5 to 18 and the impedance value of the Smith Chart is considerably away from a value of 50 Ω situated at the center of the Smith Chart, so it can be appreciated that the reflection loss value of the antenna increases and, therefore, the conventional antennas each have a relatively narrow band of frequencies.

Additionally, the conventional antenna is problematic in that the efficiency of the conventional antenna is deteriorated because the unbalance condition that is a problem in the conventional antenna is not overcome.

SUMMARY OF THE INVENTION

Accordingly, the present invention has been made keeping in mind the above problems occurring in the prior art, and an object of the present invention is to provide a multiple band-type antenna and method of producing the same, which can improve the efficiency of the antenna by overcoming an unbalance condition that is a problem in the conventional antenna, and can immediately cope with frequency variation resulting from various services because the antenna can accommodate various frequencies.

In order to accomplish the above object, there is provided a multiple bands type antenna that comprises a connector having threads on its outer surface; a circular plate formed on an upper surface of the connector; a connection member that is formed on an upper surface of the circular plate and has a space forming an impedance transformer; a first helical antenna formed at an end of the connection member wherein said first helical antenna is integrally formed based on a cutting process of a cylindrical metallic rod; a dielectric having a center passing an inner side of the first helical antenna and an outer side of the connection member; and a covering member insert-molded on an outer surface of the first helical antenna.

In addition, the present invention provides a method of producing a multiple band-type antenna, comprising the 1st production step of forming a connector by threading a circumferential surface of a cylindrical metallic rod having a certain length and a certain diameter and forming a processed portion machined to be hollow above the connector; the 2nd production step of forming a connection member having a space at a position where the connector and the processed portion are positioned near each other; the 3rd production step of forming a first helical antenna element by forming a helical shape from a position spaced apart from the space of the connection member; the 4th production step of disposing a dielectric element arranged inside the first helical antenna element formed by the 3rd production step, formed to be hollow, and leaked out of the connection member having the space and the first helical antenna element to surround the connection member; and the 5th production step of insert-molding a covering member outside the first helical antenna element.

DETAILED DESCRIPTION OF THE PREFERRED EMBODIMENT

An embodiment of the present invention will be described in detail with reference to the attached drawings below.

Figure 1:
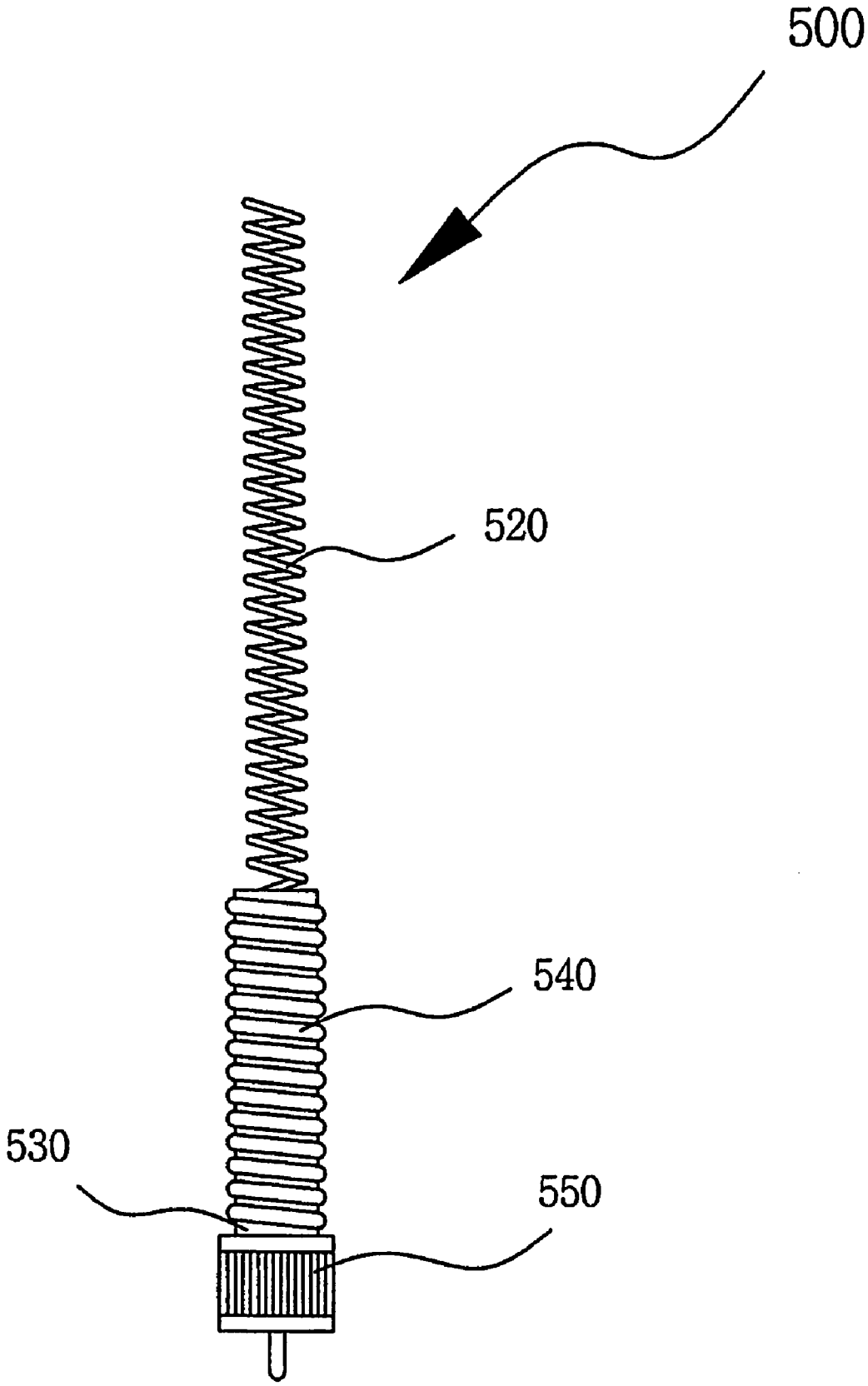
FIGS. 1 and 2 are sectional views showing the structures of conventional antennas.
Figure 2:
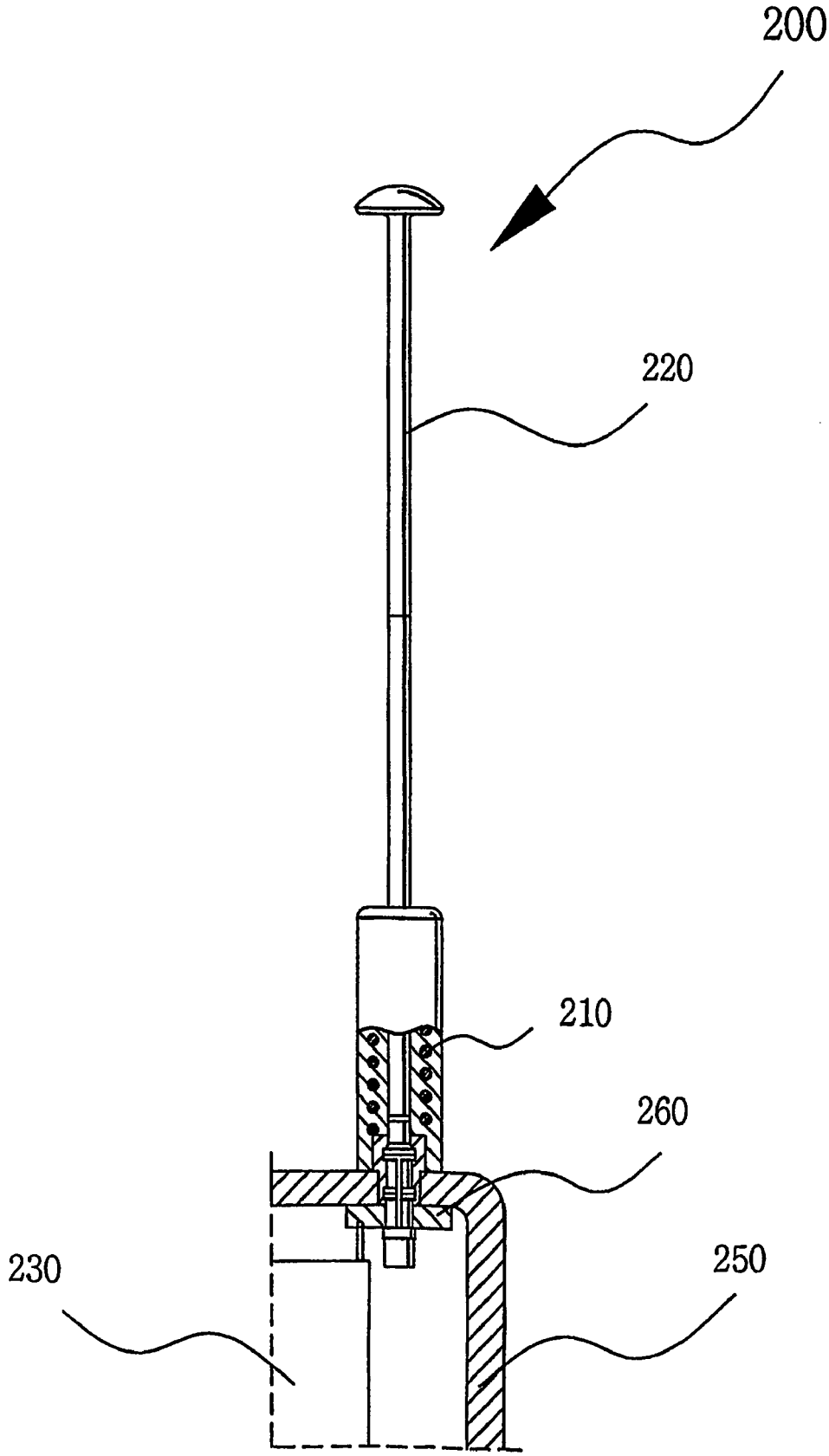
Figure 3:
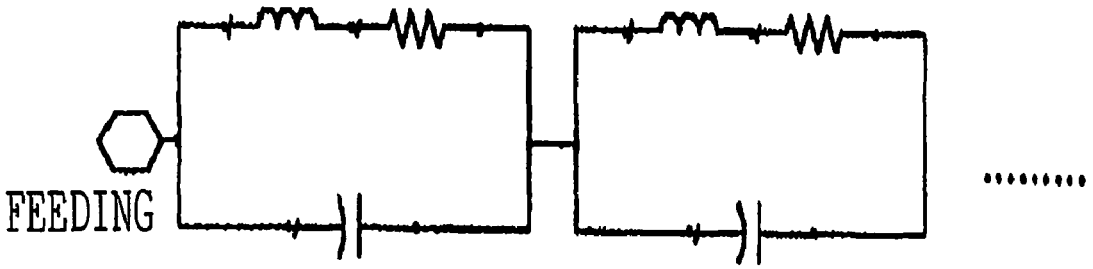
FIG. 3 is a circuit equivalent to the structure in which a helical antenna element is mounted in a cylindrical structure.
Figure 4A:
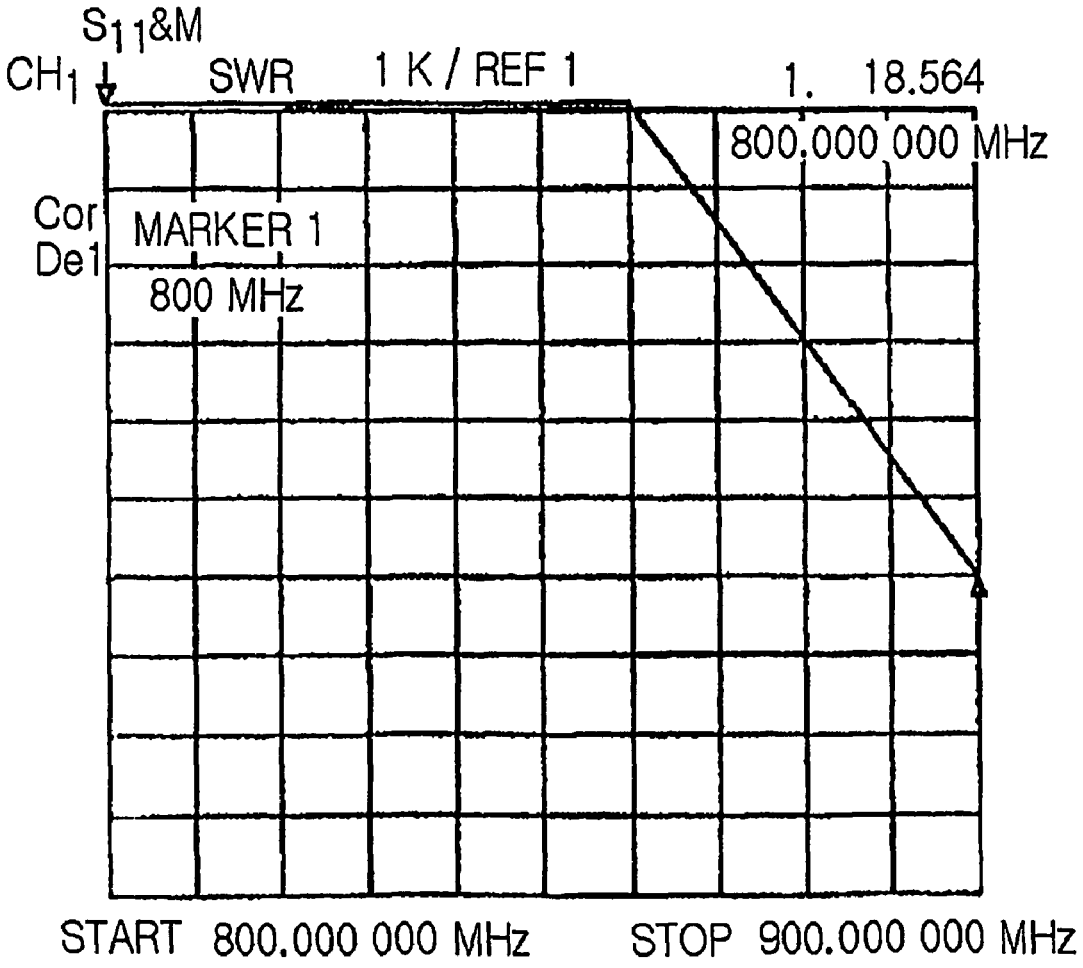
FIG. 4*a* is a graph showing electrical characteristics measured in VSWRs in the case where a helical antenna element is mounted in a cylindrical fixing means.
Figure 4B:
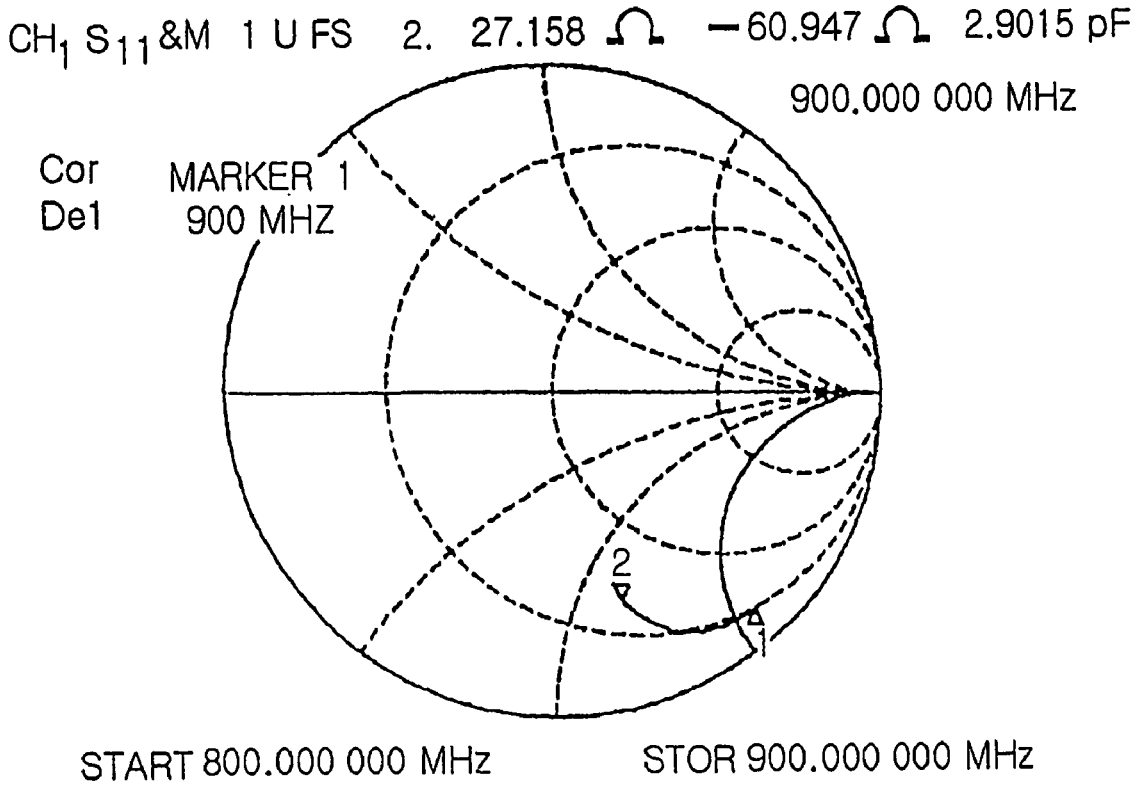
FIG. 4*b* is a Smith Chart showing impedance measurement data in the case where the helical antenna element is mounted in the cylindrical fixing means.
Figure 5A:
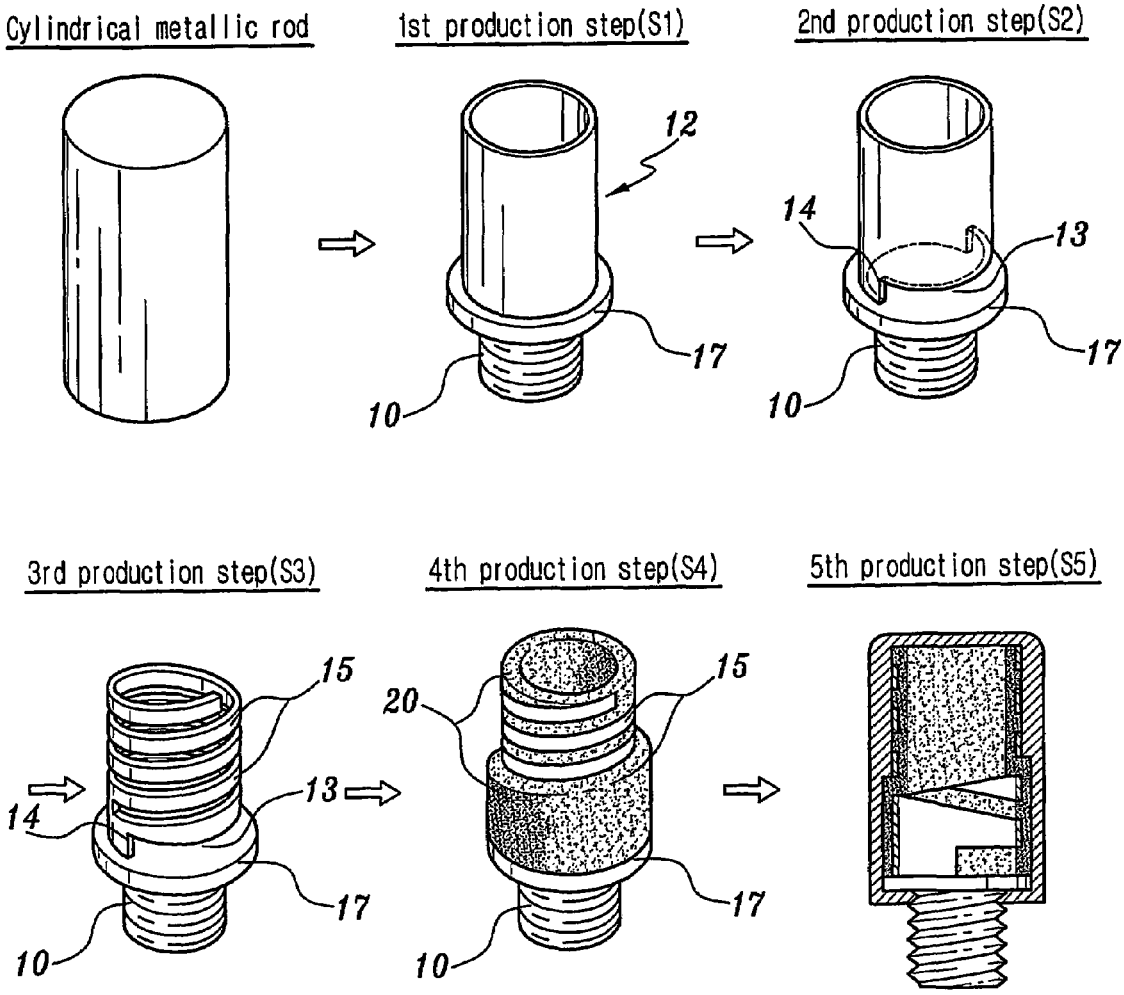
FIG. 5*a* is a view showing a method of producing a multiple band-type antenna to which the technology of the present invention is applied.

FIG. 5*a* is a view showing a method of producing a multiple band-type antenna to which the technology of the present invention is applied. Referring to this drawing, a connector 10 is formed by externally threading the circumferential surface of a cylindrical metallic rod having a certain length and a certain diameter and a workpiece is processed to have a hollow processed portion 12 above the connector 10 through the 1st production step S1. A connection member 14 having a space 13 is formed at a position where the hollow processed portion 12 formed through the 1st production step S1 and the connector 10 are positioned near each other through the 2nd production step S2.

Meanwhile, a first helical antenna element 15 is formed to have a helical shape from a position spaced apart from the space 13 of the connection member 14 through the 3rd production step S3. A dielectric element 20 is formed by being disposed inside the first helical antenna element formed by the 4th production step, formed to be hollow, and leaked out of the connection member 14 having the space 13 and the first helical antenna element 15 to surround the connection member 14.

After the dielectric element 20 is formed, the production of the antenna is completed by the 5th production step of insert-molding a covering member 30 out of the first helical antenna element 15.

Figure 5B:
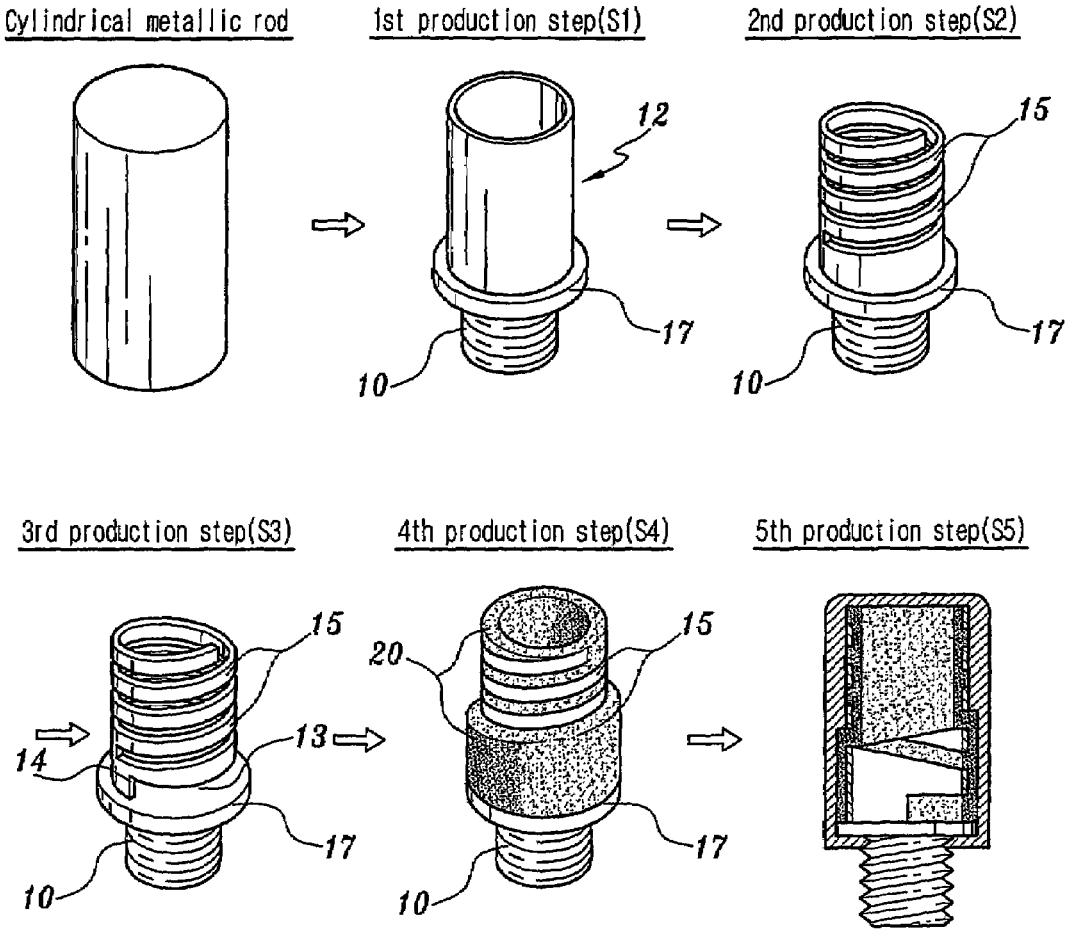
FIG. 5*b* is a view showing another method of producing the multiple band-type antenna.

As illustrated in FIG. 5*b*, in another method of the present invention, a connector 10 is formed by externally threading the circumferential surface of a cylindrical metallic rod having a certain length and a certain diameter and a workpiece is processed to have a hollow processed portion 12 above the connector 10 through the 1st production step S1. A first helical antenna element 15 is formed by fabricating the processed portion 12 to have a helical shape through the 3rd production step S3. Thereafter, a connection member 14 having a space 13 is formed at a position near an end of the first helical antenna element 15 integrated with a circular plate 17.

A dielectric element 20 is formed by being disposed inside the first helical antenna element formed by the 3rd production step, formed to be hollow, and leaked out of the connection member 14 having the space 13 and the first helical antenna element 15 to surround the connection member 14.

After the dielectric element 20 is formed, the production of the antenna is completed by the 5th production step of insert-molding a covering member 30 outside the first helical antenna element 15.

Figure 10A:
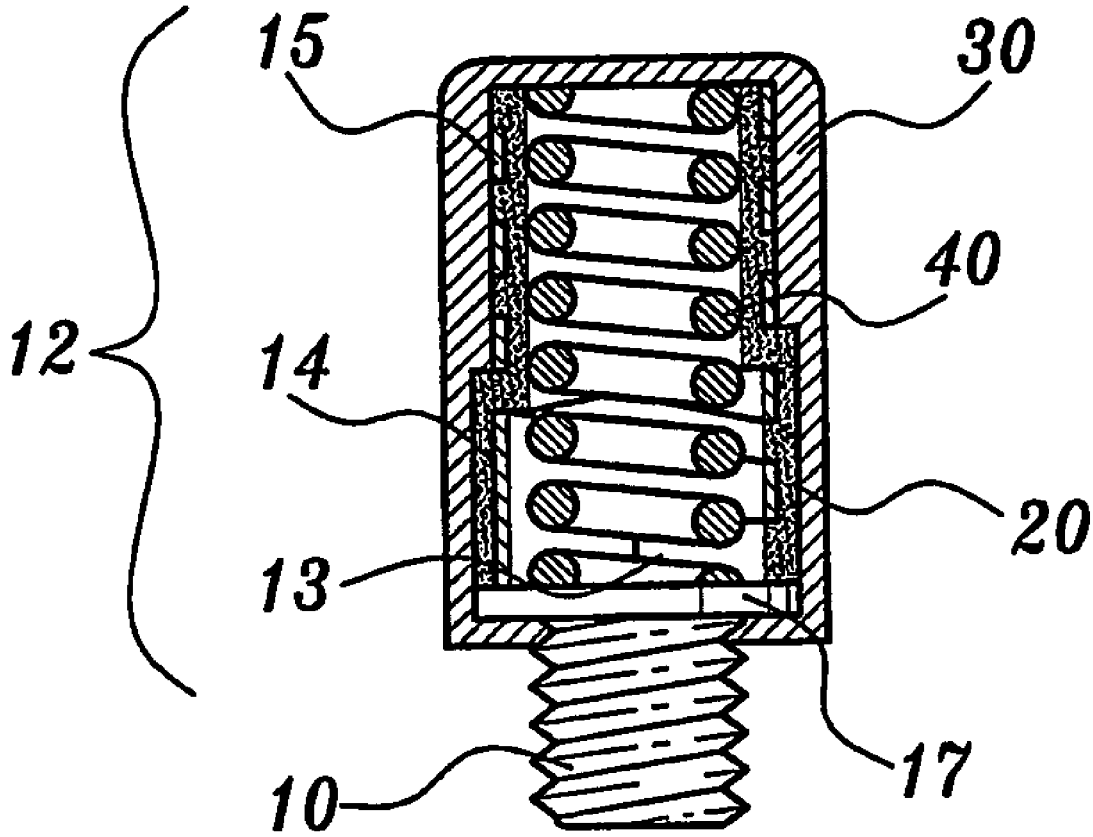
FIGS. 10*a* to 10*d* are sectional views showing antennas in accordance with other embodiments of the present invention.
Figure 10B:
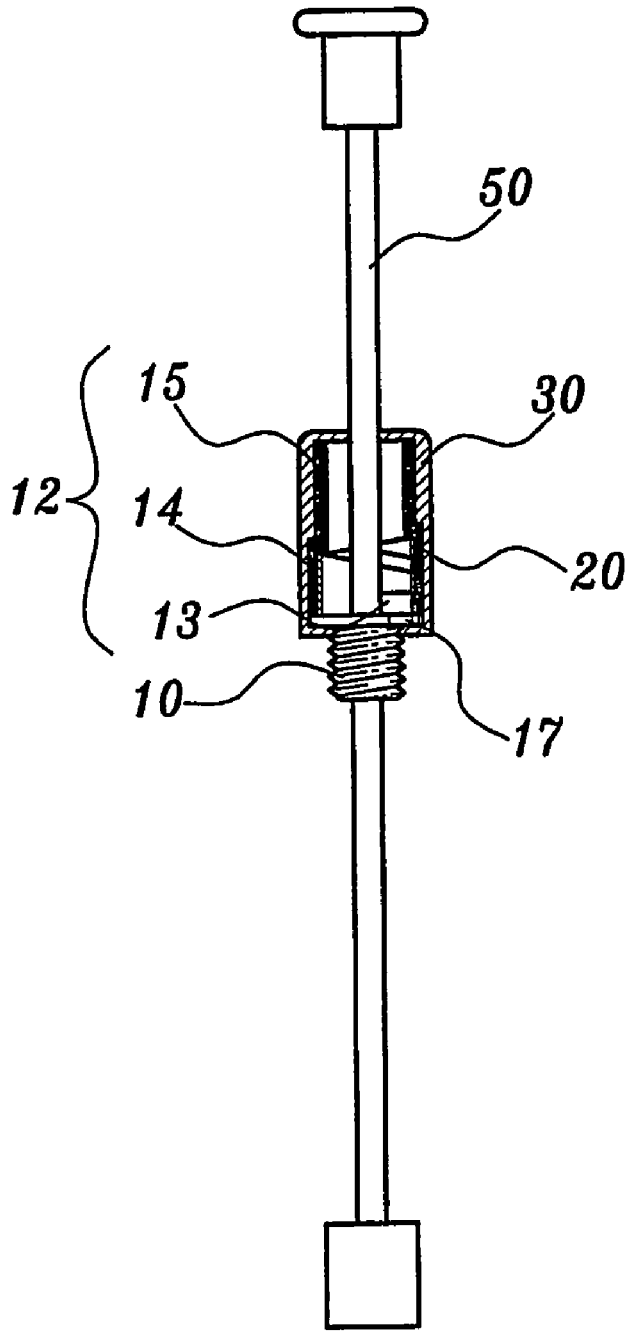

In the meantime, for other embodiments of the present invention, there can be employed a multiple band antenna producing method of disposing a second helical antenna element 40 inside a dielectric element 20 formed by a 3rd production step before insert-molding a covering member 30 as shown in FIG. 10*a*, and a multiple band antenna producing method of disposing a whip antenna 50 after insert-molding a covering member 30 as shown in FIG. 10*b*.

Figure 10C:
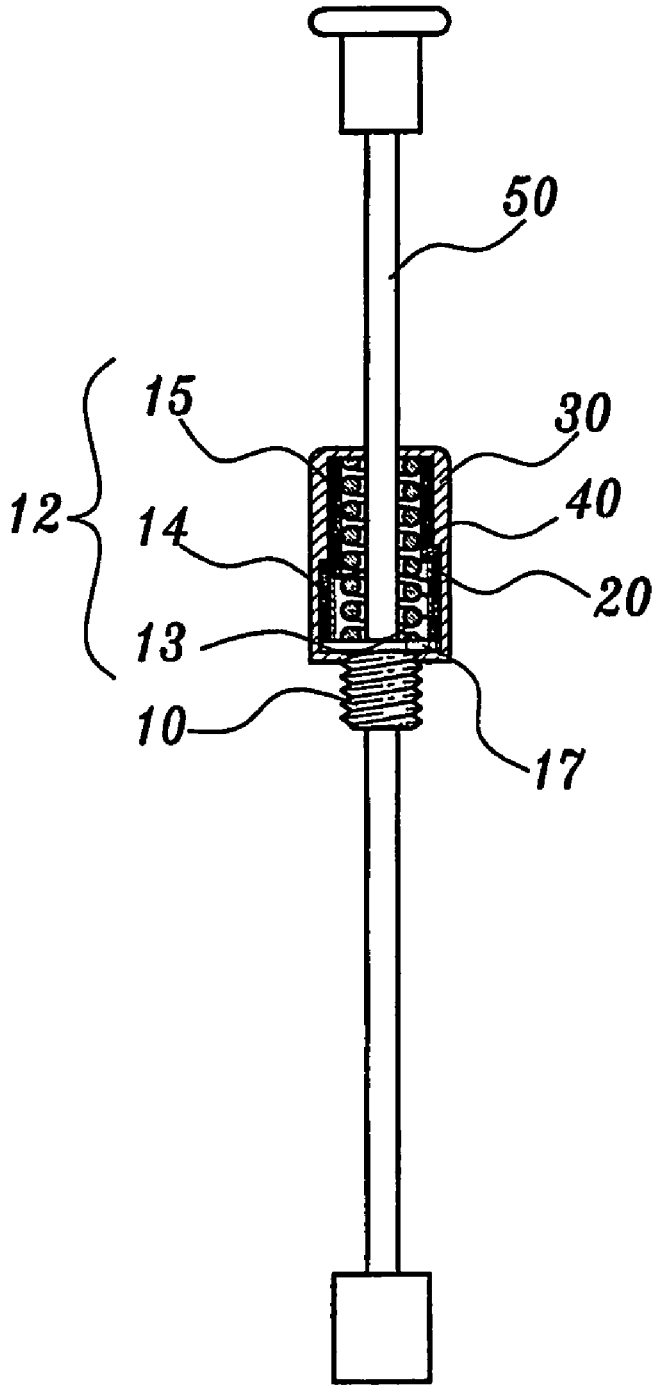
Figure 10D:
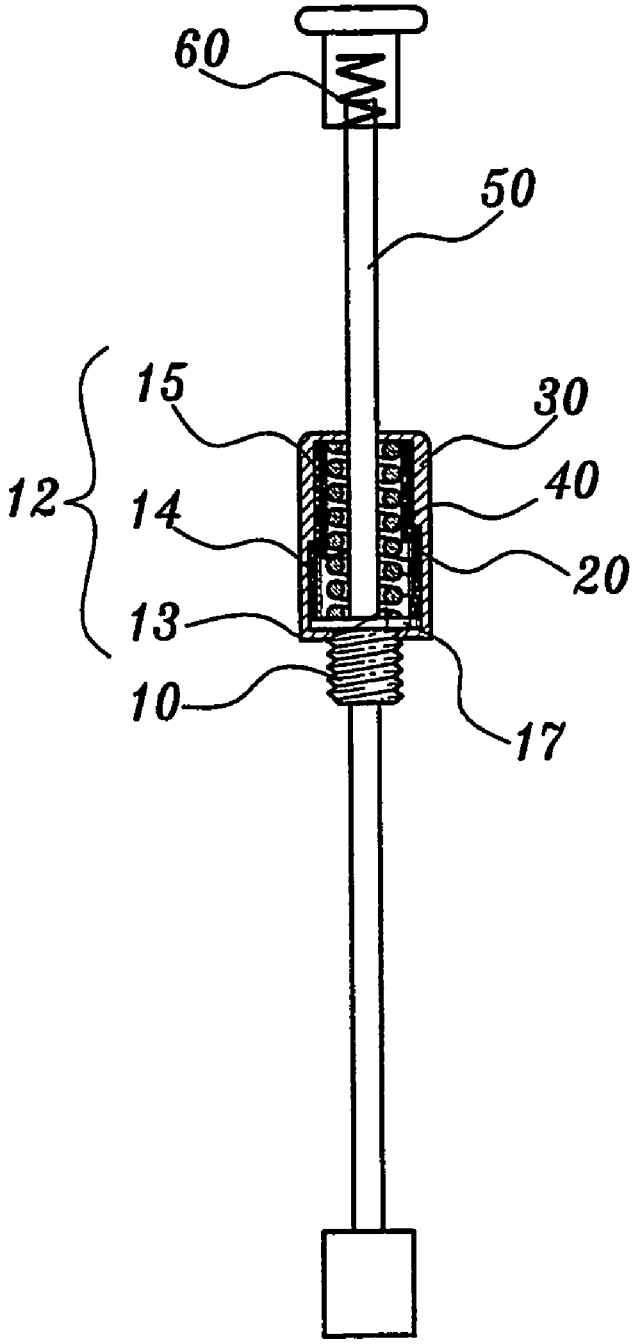

For other embodiments of the present invention, there can be employed a method of coating the outer surface of a second helical antenna element 40 arranged inside a first helical antenna element 15 with a dielectric element, and a method of arranging a second helical antenna element 40 and arranging a whip antenna 50 after insert-molding a covering member 30 as shown in FIG. 10*c*, or inserting a third helical antenna element 60 into one end of a whip antenna 50 as shown in FIG. 10*d*.

Additionally, the assembly time of the antenna may be reduced and the convenience of the production of the antenna may be improved by changing the covering member 30 made by insert-molding to a cap structure.

The antenna fabricated by the above-described methods can improve the efficiency of the antenna by overcoming the unbalance condition that is a problem in the conventional antenna, and can immediately cope with the variation of a frequency resulting from various services because the antenna can accommodate various frequencies.

Meanwhile, in another method of the present invention, the sequence of the former method in which the 3rd production step S3 is performed after the 2nd production step S2 may be changed to a sequence in which the 2nd production step S2 is performed after the 3rd production step S3. The reason for this is that the sequence of production may be determined depending upon the convenience of production.

The structure of the multiple band-type antenna produced by the production method of the present invention is described below.

Figure 6:
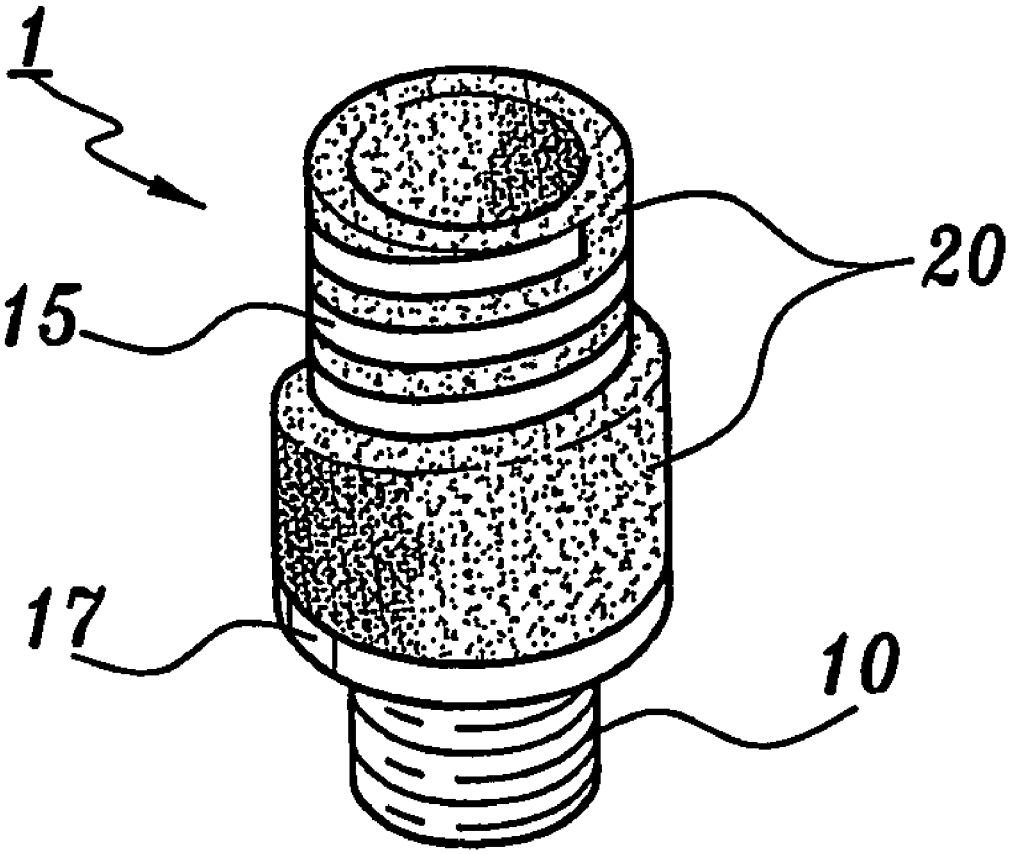
FIG. 6 is a perspective view showing the structure of the antenna of the present invention.

FIG. 6 is a perspective view showing the structure of the antenna to which the technology of the present invention is applied. Referring to this drawing, in the multiple band-type antenna 1 to which the technology of the present invention is applied, a disk 17 is integrated with an externally threaded connector 10, a connection member 14 provided with a space 13 is formed on the upper surface of the circular plate 17, a first helical antenna element 15 is integrally formed from the upper end of the connection member 14, and a dielectric element 20 is installed to be inserted into the first helical antenna element 15 and formed to be hollow.

Figure 7:
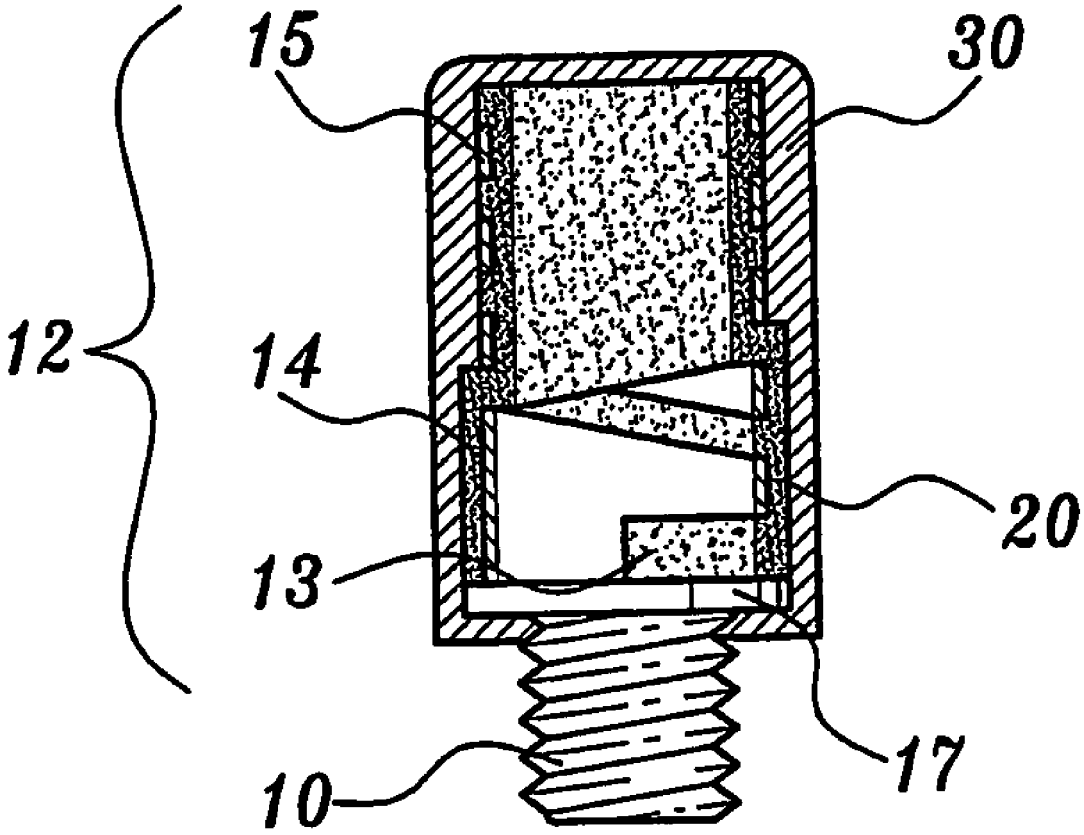
FIG. 7 is a cross sectional view showing an engaged structure of a connection member and a dielectric that are important elements, of the present invention.

As shown in FIGS. 5 to 7, a dielectric element 20 is inserted into the first helical antenna element 15, formed to be hollow, and leaked between the connection member 14 and the base of the first helical antenna element 15 to surround the connection member 14, and a covering member 30 is insert-molded outside the first helical antenna element 15.

In the meantime, the reason why the dielectric element 20 is formed to leak to a position where the connection member 14 and the first helical antenna element 15 begin and to surround the connection member 14 is to prevent the material of the covering member 30 from entering and filling the space 13 constituting the impedance transformer.

In an operation and effect of an antenna according to the present invention having a single band as shown in FIGS. 5*a* and 5*b*, a connector 10 having threads on an outer surface is fixedly installed at a housing, and a circular plate 17 is installed to prevent deflection.

In addition, a certain space 13 formed between the first helical antenna 15 and the circular plate 17 in such a manner that a part of the connection member 14 is cut acts as an impedance transformer.

Impedance varies depending upon the length of the first helical antenna element 15 and the bandwidth is generally determined by the structure, so the capacitive component of the helical antenna element has wide-band characteristics by the deformation of the feeding part in an early stage of impedance matching.

Actually, the increase of a series inductance effect has the same meaning as the decrease of a series capacitance effect occurring between the impedance transformer and the helical antenna that generally occurs in a helical antenna.

Accordingly, it can be appreciated that resonance is generated in a space. Results according to the above-described structure are described below.

When the resonance circuit of the antenna generates parallel resonance, a Q value (the quality factor of a reactance element or resonance circuit having losses) considerably increases, so bandwidth thereof considerably decreases.

However, in the present invention, when the structure is converted into a distributed constant circuit and input impedance viewed at a feeding point is caused to generate series resonance, a desired bandwidth can be achieved over a relatively wide band of frequencies.

Meanwhile, the reason why parallel resonance, which is a general characteristic, is transformed to series resonance through the use of an impedance transformer is that the antenna is caused to have a pure resistance value by compensating for an inherent capacitance value of the helical antenna through the use of a structure.

Figure 8:
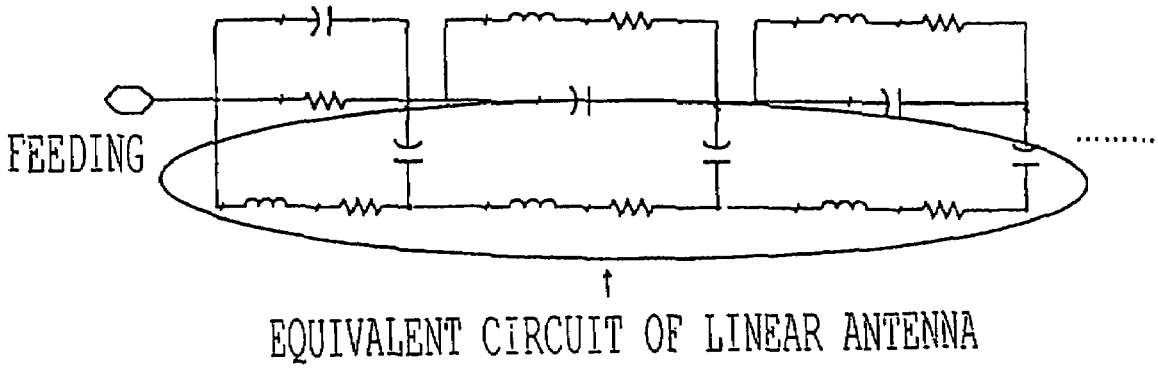
FIG. 8 is an equivalent circuit of a structure that a connection member and a first helical antenna are integral in FIG. 7.
Figure 9A:
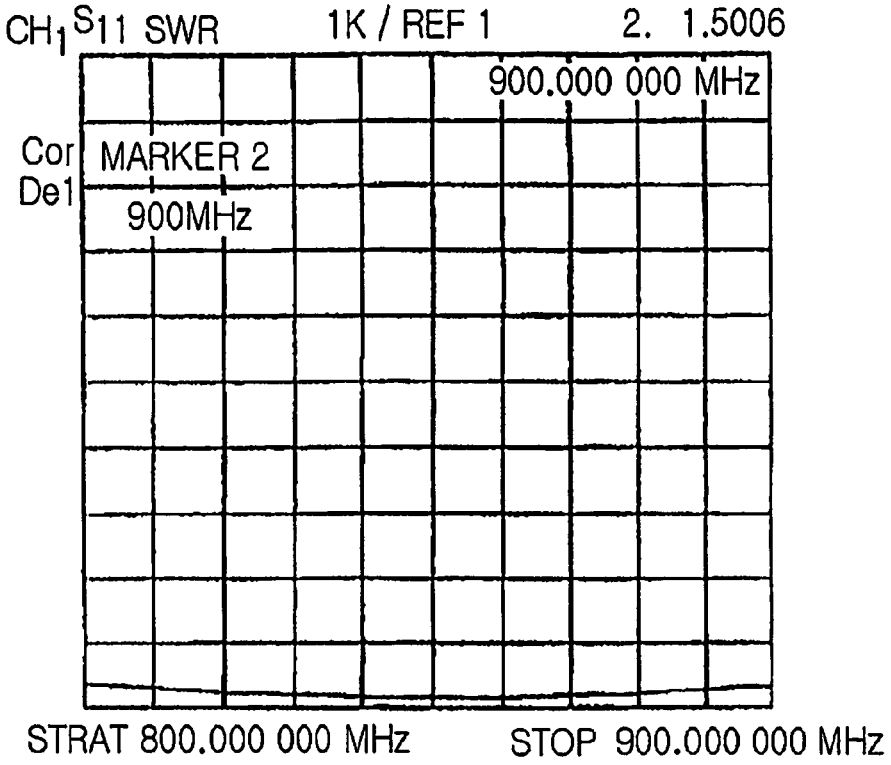
FIG. 9*a* is a graph that an electrical characteristic of a structure that a connection member and a helical antenna are integral in FIG. 7 wherein the characteristic is measured based on a VSWR.
Figure 9B:
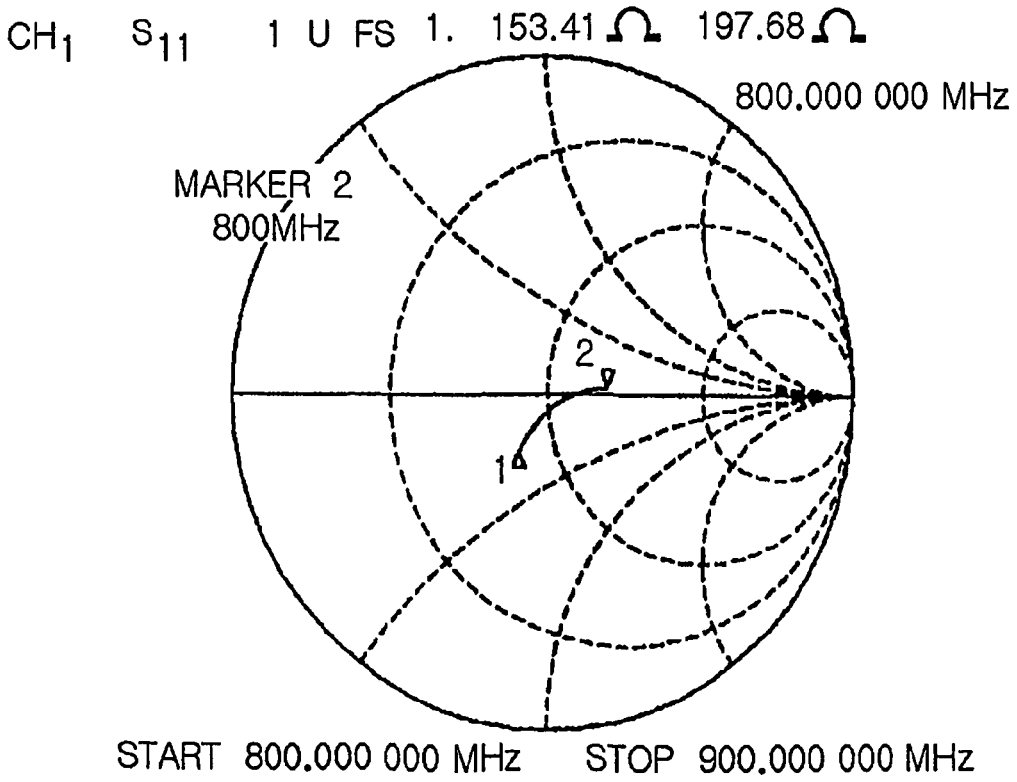
FIG. 9*b* is a Smith chart showing an impedance measurement data of a structure that a connection member and a first helical antenna are integral.

In this case, the parallel resonance of C of the parallel resonance part and the impedance transformer and L of the helical antenna element is exhibited by inserting the impedance transformer, which is equivalent to a parallel structure of a small R and a large C, between a feeding part and a parallel resonance part as shown in FIG. 8, so a frequency neighboring the center frequency of the dual resonance becomes the frequency of the serial resonance.

Accordingly, the frequency and the gain are all improved due to the resonance of the neighboring frequency. This means that the bandwidth is broadened by compensating for the increase of a Q value resulting from the L-C parallel resonance with serial resonance.

In the meantime, the series resonance frequency neighboring the center frequency can be flexibly adjusted because the C value of the impedance transformer in the equivalent circuit is adjusted according to the size of the space 13. The working bandwidth can be adjusted according to a required bandwidth regardless of the matching circuit, and can be adjusted by widening the area of the first helical antenna.

Meanwhile, in the antenna having a structure as shown in FIG. 5, a contact is formed below the structure by inserting a whip antenna 50 into a first helical antenna 13 to penetrate the central portion thereof, which changes resonance characteristics, thus obtaining the desired frequency and gain.

The reason for changing resonance characteristics by inserting the whip antenna 50 into the fixed structure, which forms the space with the first helical antenna 15 inserted therein, is to cause the reduction of the Q value by affecting series resonance characteristics originating in the impedance transformer and parallel resonance characteristics originating in the helical element due to a coupling effect between the whip antenna 50 and the helical antenna because the whip antenna 50 and the helical antenna are simultaneously fed.

Gains are compared with one another depending upon the positions of the whip antenna electrically connected to the helical antenna as follows:

1. Comparison of gains depending upon frequencies when the whip antenna is extended from the helical antenna

| Frequency (MHz) | Conventional antenna (dBm) | Present Antenna (dBm) | Gain comparison (dB) |
|---|---|---|---|
| 822 | −20.64 | −19.86 | +0.78 |
| 851 | −21.17 | −21.15 | +0.02 |
| 867 | −20.53 | −20.37 | +0.16 |
| 898 | −20.87 | −20.70 | +0.170 |

2. Comparison of gains depending upon frequencies when the whip antenna is retracted into the helical antenna

| Frequency (MHz) | Conventional antenna (dBm) | Present Antenna (dBm) | Gain comparison (dB) |
|---|---|---|---|
| 822 | −19.31 | −19.22 | +0.09 |
| 851 | −20.53 | −20.25 | +0.28 |
| 867 | −19.56 | −19.32 | +0.24 |
| 898 | −19.93 | −19.93 | +0.00 |

Accordingly, the frequency band of the antenna may be extended by changing only a fixed structure but not the antenna and compensating for parallel resonance, which is the general characteristics of monopole and dipole antennas, with series resonance.

Actually, the increase of a series inductance effect has the same meaning as the decrease of a series capacitance effect that is generated between the fixed structure and the helical antenna.

In the general antenna, as the working frequency band thereof is broadened, the gain thereof decreases, and as the working frequency band thereof. is narrowed, the gain thereof increases. In contrast, the antenna of the present invention is significantly different from the conventional antenna in effect, in that as the frequency band thereof is broadened, the gain thereof increases, and as the frequency band is narrowed, the gain thereof decreases.

Meanwhile, FIG. 10*a* is a sectional view showing another structure of a multiple band-forming antenna according to the present invention, which is formed by disposing a second helical antenna element 40 inside a dielectric element 20 with one end thereof grounded onto a circular plate 17 and the other end made free. The reason why the lower portion of the dielectric element 20 preventing a covering member from entering and filling an inner space are projected outward is that a first helical antenna element 15 and the second helical antenna element 40 are positioned inside while being prevented from coming into contact with each other.

In the meantime, an additional coating layer made of dielectric element may be formed around the second helical antenna element 40 disposed inside the first helical antenna element 15. In this case, the coating layer can reliably prevent the first and second helical antenna elements 15 and 40 from coming into contact with each other.

Figure 11A:
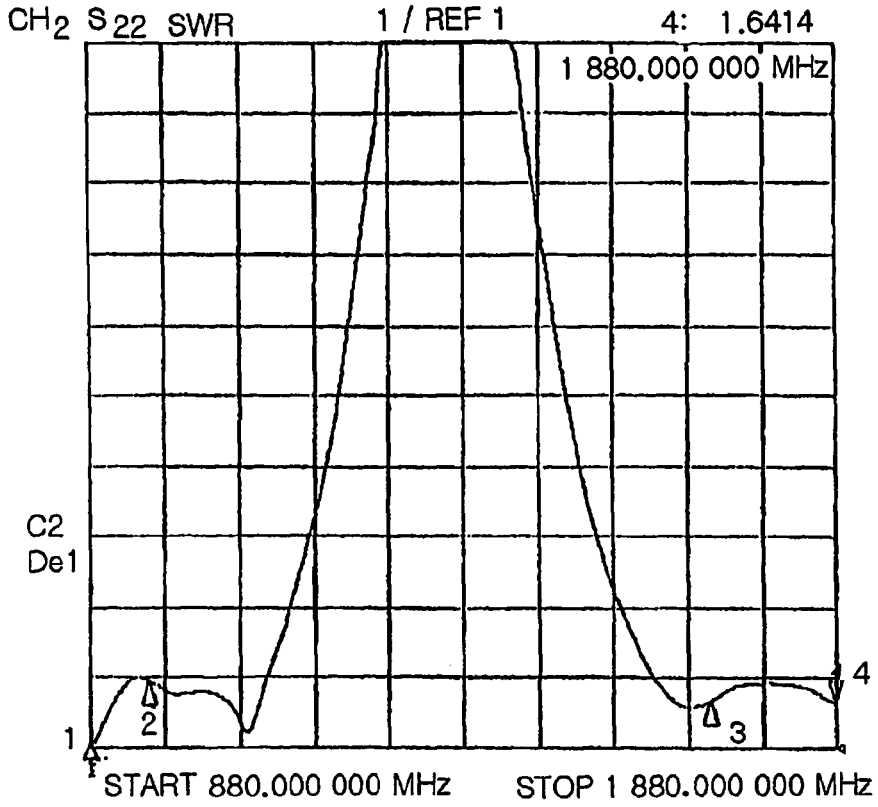
FIG. 11*a* is a graph of a structure that a second helical antenna is installed in a structure that a connection member and a first helical antenna are integral wherein the characteristic is measured based on a VSWR.
Figure 11B:
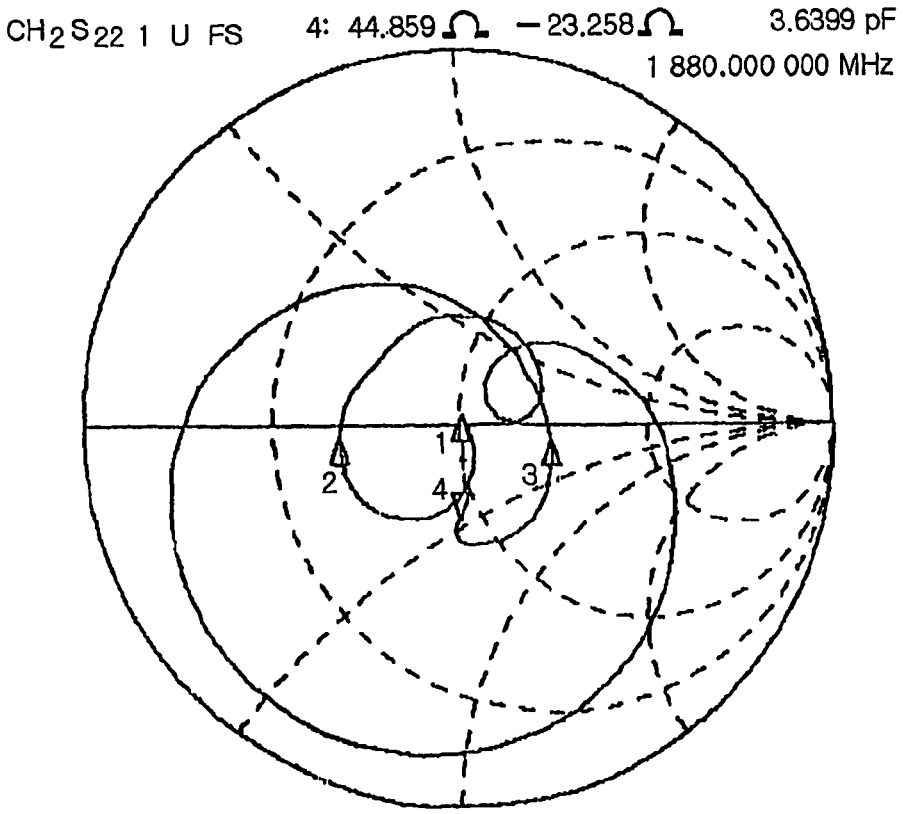
FIG. 11*b* is a Smith chart showing an impedance measurement data after a second helical antenna is installed in a structure that a connection member and a first helical antenna are integral.

The operation and effect of an antenna in which a dual-band is formed by disposing a second helical antenna element 40 inside a first helical antenna element 15, as shown in FIG. 10*b* in accordance with an embodiment of the present invention, are that in the case where the VSWR is two or less, the antenna has a bandwidth of 230 MHz over a band of 800 to 900 MHz and a bandwidth of 250 MHz over a band of 1800 to 1900 MHz, as shown in FIGS. 11*a* and 11*b*.

Meanwhile, as illustrated in FIG. 10*c*, in a structure where a second helical antenna element 40 is disposed inside the a first helical antenna element 15 and a whip antenna 50 is disposed to pass through the second helical antenna element 40, gains are compared with one another depending upon the positions of the whip antenna electrically connected to the helical antenna as follows:

1. Comparison of gains depending upon frequencies when the whip antenna is extended from the helical antenna

| Frequency (MHz) | Conventional antenna (dBm) | Present Antenna (dBm) | Gain comparison (dB) |
|---|---|---|---|
| 890 | −47.72 | −46.58 | +1.14 |
| 960 | −47.69 | −46.72 | +0.97 |
| 1710 | −52.37 | −51.89 | +0.48 |
| 1880 | −53.17 | −51.85 | +1.32 |

2. Comparison of gains depending upon frequencies when the whip antenna is retracted into the helical antenna

| Frequency (MHz) | Conventional antenna (dBm) | Present Antenna (dBm) | Gain comparison (dB) |
|---|---|---|---|
| 890 | −49.69 | −49.15 | +0.54 |
| 960 | −50.52 | −49.80 | +0.72 |
| 1710 | −54.69 | −54.34 | +0.35 |
| 1880 | −56.72 | −55.22 | +1.5 |

Accordingly, it can be appreciated that the antenna having a structure according to an embodiment of the present invention has an improved bandwidth compared with the case where only the first helical antenna element is disposed. The frequency band of the antenna may be extended by changing only a fixed structure but not the antenna and by compensating for parallel resonance, which is the general characteristics of monopole and dipole antennas, with series resonance.

Figure 12A:
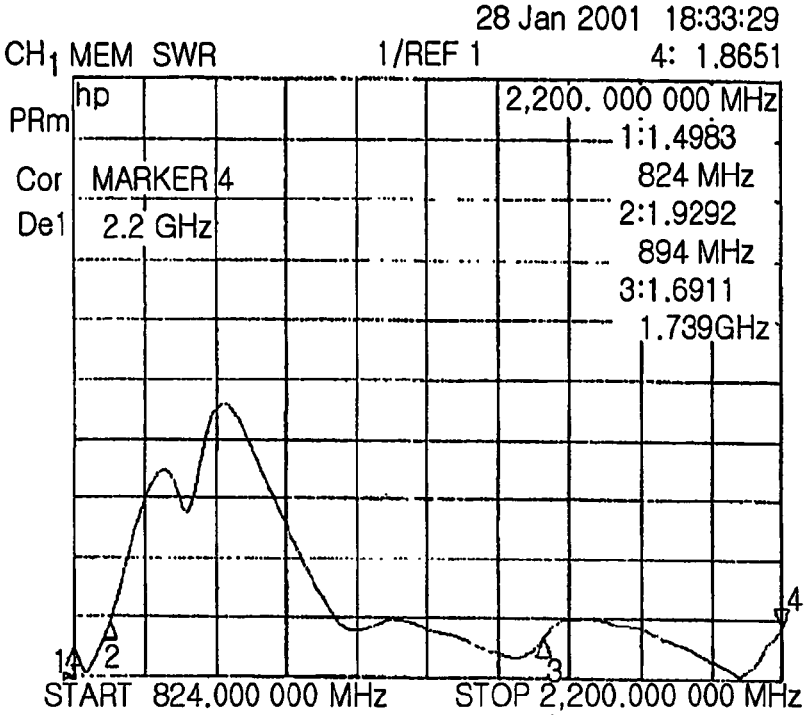
FIG. 12*a* is a graph showing an electrical characteristic based on a VSWR measurement after a third helical antenna is installed in a structure that a second helical antenna is installed.
Figure 12B:
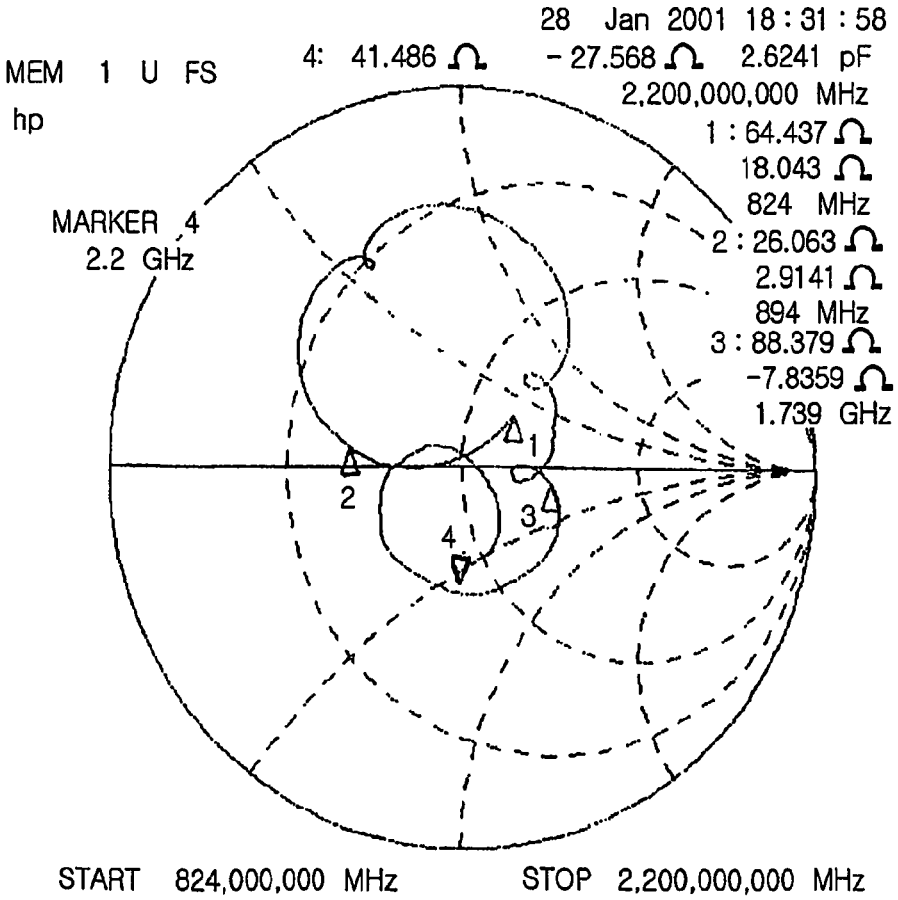
FIG. 12*b* is a Smith chart showing an impedance measurement data after a third helical antenna is installed in a structure that a second helical antenna is installed.

The operation and effect of an antenna in which a triple-band is formed by disposing a whip antenna element 60 through the central portion of an insert-molded covering member 30 and positioning a third helical antenna element 60 in an upper portion of-the whip antenna as shown in FIG. 10*d* in accordance with an embodiment of the present invention are that in the case where the VSWR is two or less, the antenna has a bandwidth of 140 MHz over a band of 800 MHz to 900 MHz and a bandwidth of 700 MHz over a band of 1800 to 1900 MHz and a band of 1885 to 2200 MHz as shown in FIGS. 12*a* and 12*b*.

Meanwhile, gains are compared with one another depending upon the positions of the whip antenna electrically connected to the helical antenna as follows:

1. Comparison of gains depending upon frequencies when the whip antenna is extended from the helical antenna

| Frequency (MHz) | Conventional Antenna (dBm) | Present Antenna (dBm) | Gain comparison (dB) |
|---|---|---|---|
| 824 | −48.19 | −47.47 | +0.72 |
| 894 | −47.98 | −47.47 | +0.51 |
| 1750 | −53.21 | −53.08 | +0.13 |
| 1870 | −53.22 | −51.75 | +1.47 |
| 1885 | −59.69 | −58.75 | +1.25 |
| 2200 | −59.42 | −58.35 | +1.07 |

Comparison of gains depending upon frequencies when the whip antenna is retracted into the helical antenna

| Frequency (MHz) | Conventional Antenna (dBm) | Present Antenna (dBm) | Gain comparison (dB) |
|---|---|---|---|
| 824 | −50.65 | −50.22 | +0.43 |
| 894 | −51.05 | −50.39 | +0.66 |
| 1750 | −55.46 | −55.04 | +0.42 |
| 1870 | −54.92 | −53.62 | +1.3 |
| 1885 | −60.18 | −59.01 | +1.17 |
| 2200 | −60.07 | −59.09 | +0.98 |

Accordingly, it can be appreciated that the antenna having a structure according to another embodiment of the present invention has an improved bandwidth compared with the general antenna forming a triple band, like antennas forming a single band and a dual band described above. The frequency band of the antenna may be extended by changing only a fixed structure but not the antenna and compensating for a parallel resonance, which is the general characteristics of monopole and dipole antennas, with series resonance.

In the meantime, a single band and a dual band-may be generated by adjusting the size and shape of a space using an antenna generating a triple band. The present invention converts parallel resonance into series resonance by changing the space of the structure, so a certain antenna generally and parallelly resonating at its center frequency obtains a working frequency range two to three times greater than the existing one and the gain thereof is improved.

According to the multiple bands type antenna and method for producing the same, a connection member 14 having a certain space 13 forming an impedance transformer is integrally formed between integral helical antenna and connector. A dielectric surrounding the inner and outer portions of the helical antenna and connection member is installed. The helical antenna and whip antenna are additionally installed about an inner side of the dielectric. An unbalance problem in the conventional antenna structure is improved in the present invention, and different frequencies are satisfied. The efficiency of antenna is enhanced. It is possible to quickly cope with the movement of a center frequency due to changing service environments of an antenna.

What is claimed is:

1. A method of producing a multiple band-type antenna, comprising:

a first step in which a connector is formed by forming threads on an outer surface of a cylindrical metallic rod having a certain length and a certain diameter, and a hollow processed portion is formed in an upper part of the metallic rod;

a second step in which a connection member is formed between the hollow processed portion and the connector in such a manner that the connection member connects the hollow processed portion and the connector has a space functioning as an impedance transformer;

a third step in which a first helical antenna is formed on the hollow processed portion;

a fourth step in which a dielectric is provided to surround the connection member and to support the first helical antenna; and a fifth step in which a covering member is insert-molded on an outer surface of the first helical antenna.

2. The method of claim 1, wherein the second step is performed after the third step is performed.

3. The method of claim 1, further comprising a step in which a second helical antenna is installed at an inner side of the first helical antenna before the fifth step.

4. The method of claim 3, further comprising a step in which a whip antenna passing through the second helical antenna is installed after the fifth step.

5. The method of claim 3, wherein a dielectric is coated on an outer surface of the second helical antenna installed at an inner side of the first helical antenna.

6. The method of claim 1, wherein the covering member formed by the insert molding method is formed in a shape of a cap.

7. The method of claim 1, wherein an available frequency range is adjusted by adjusting the size of the space.

8. The method of claim 1, further comprising a step in which a whip antenna is installed to pass through the first helical antenna after the fifth step.

9. The method of claim 8, wherein a third helical antenna is installed at an end of the whip antenna.

10. A method of producing a multiple band-type antenna, comprising:

a first step in which a connector is formed by forming threads on an outer surface of a cylindrical metallic rod having a certain length and a certain diameter;

a second step in which a connection member is formed in such a manner that a certain space has an impedance transformer at a portion near a processed portion formed as a center passes through and near the connector;

a third step in which a spiral first helical antenna is formed from an end of the connection member distanced by a certain interval from the space formed in the connection member;

a fourth step in which a dielectric is provided to surround the connection member in such a manner that said dielectric is exposed from the portions that the connection member that is inserted into an inner side of the first helical antenna formed in the third step, has a passed-through center and a certain space, and the first helical antenna are getting started to be formed; and a fifth step in which a covering member is insert-molded on an outer surface of the first helical antenna, further comprising a step in which a second helical antenna is installed at an inner side of the dielectric formed in the fourth step before the covering member is insert-molded, and further comprising a step in which a whip antenna passing through a center is installed after the second helical antenna is installed, and the covering member is insert-molded.

11. A method of producing a multiple band-type antenna, comprising:

a first step in which a connector is formed by forming threads on an outer surface of a cylindrical metallic rod having a certain length and a certain diameter;

a second step in which a connection member is formed in such a manner that a certain space has an impedance transformer at a portion near a processed portion formed as a center passes through and near the connector;

a third step in which a spiral first helical antenna is formed from an end of the connection member distanced by a certain interval from the space formed in the connection member;

a fourth step in which a dielectric is provided to surround the connection member in such a manner that said dielectric is exposed from the portions that the connection member that is inserted into an inner side of the first helical antenna formed in the third step, has a passed-through center and a certain space, and the first helical antenna are getting started to be formed; and a fifth step in which a covering member is insert-molded on an outer surface of the first helical antenna, further comprising a step in which a second helical antenna is installed at an inner side of the dielectric formed in the fourth step before the covering member is insert-molded, wherein a dielectric is coated on an outer surface of the second helical antenna installed at an inner side of the first helical antenna.

12. A method of producing a multiple band-type antenna, comprising:

a first step in which a connector is formed by forming threads on an outer surface of a cylindrical metallic rod having a certain length and a certain diameter;

a second step in which a connection member is formed in such a manner that a certain space has an impedance transformer at a portion near a processed portion formed as a center passes through and near the connector;

a third step in which a spiral first helical antenna is formed from an end of the connection member distanced by a certain interval from the space formed in the connection member;

a fourth step in which a dielectric is provided to surround the connection member in such a mariner that said dielectric is exposed from the portions that the connection member that is inserted into an inner side of the first helical antenna formed in the third step, has a passed-through center and a certain space, and the first helical antenna are getting started to be formed; and a fifth step in which a covering member is insert-molded on an outer surface of the first helical antenna, further comprising a step in which a whip antenna is installed at an assembly formed after the covering member is insert-molded.

13. The method of claim 12, further comprising a third helical antenna installed at an end of one side of the whip antenna.

14. A multiple bands type antenna, comprising:

a connector having threads on its outer surface;

a circular plate formed on an upper surface of the connector;

a connection member one end of which is connected to an upper surface of the circular plate;

a first helical antenna formed at the other end of the connection;

a dielectric supporting an inner side of the first helical antenna and surrounding an outer side of the connection member; and a covering member insert-molded on an outer surface of the first helical antenna, wherein the connection member forms a space between the first helical antenna and the circular plate while electrically connecting the first helical antenna and the circular plate.

15. The antenna of claim 14, further comprising a second helical antenna that has one end connected with the circular plate and the other end of which is a free end and is installed at an inner side of the first helical antenna.

16. The antenna of claim 15, wherein a coating layer formed of a dielectric is formed on an outer surface of the second helical antenna.

17. The antenna of claim 15, further comprising a whip antenna that passes through the second helical antenna.

18. The antenna of claim 17, further comprising a third helical antenna formed at an end of the whip antenna.

19. The antenna of claim 14, further comprising a whip antenna that passes through the first helical antenna.

20. The antenna of claim 14, wherein the first helical antenna has a cross section of a plate shape.

21. A multiple bands type antenna, comprising:

a connector having threads on its outer surface;

a circular plate formed on an upper surface of the connector;

a connection member that is formed on an upper surface of the circular plate and has a space forming an impedance transformer;

a first helical antenna formed at an end of the connection member wherein said first helical antenna is integrally formed based on a cutting process of a cylindrical metallic rod; and a dielectric having a center passing an inner side of the first helical antenna and an outer side of the connection member; and a covering member insert-molded on an outer surface of the first helical antenna, further comprising a second helical antenna that has one end connected with the circular plate and a free end formed at the other end of the same and is installed at an inner side of the dielectric, and further comprising a whip antenna that passes through a center portion after the second helical antenna is installed, and the covering member is insert-molded.

22. The antenna of claim 21, further comprising a third helical antenna formed at an end of one side of the whip antenna.

* * * * *